US005934199A

United States Patent [19]

Koeppl

[11] Patent Number: 5,934,199

[45] Date of Patent: Aug. 10, 1999

[54] APPARATUS FOR TEMPORARILY INCREASING THE LOAD-BEARING CAPACITY OF BRIDGE GIRDERS

[75] Inventor: Alois Koeppl, Herzogenaurach, Germany

[73] Assignee: Siemens Aktiengesellschaft, Munich, Germany

[21] Appl. No.: 08/927,565

[22] Filed: Sep. 8, 1997

[30] Foreign Application Priority Data

Sep. 6, 1996 [DE] Germany ..... 296 15 574 U

[51] Int. Cl.[6] ..... B61D 1/00

[52] U.S. Cl. ..... 105/163.1; 52/724.2; 104/117

[58] Field of Search ..... 105/163.1, 163.2; 212/312; 52/724.1, 724.2, 729.1, 737.1; 104/123, 117

[56] References Cited

U.S. PATENT DOCUMENTS

| | | | |
|---|---|---|---|
| 839,019 | 12/1906 | Miller et al. | 104/117 |
| 842,457 | 1/1907 | Harding . | |
| 4,421,242 | 12/1983 | Brueske | 105/163.1 |
| 5,791,257 | 8/1998 | Konop | 105/163.1 |

*Primary Examiner*—Robert J. Oberleitner
*Assistant Examiner*—Robert J. McCarry, Jr.
*Attorney, Agent, or Firm*—Herbert L. Lerner; Laurence A. Greenberg

[57] ABSTRACT

An apparatus for temporarily increasing the load-bearing capacity of bridge girders during assembly work includes supports with deflection pulleys that are placed in the vicinity of bracing points. A relief cable is made taut over the deflection pulleys and the bridge girder is suspended from it as well.

4 Claims, 1 Drawing Sheet

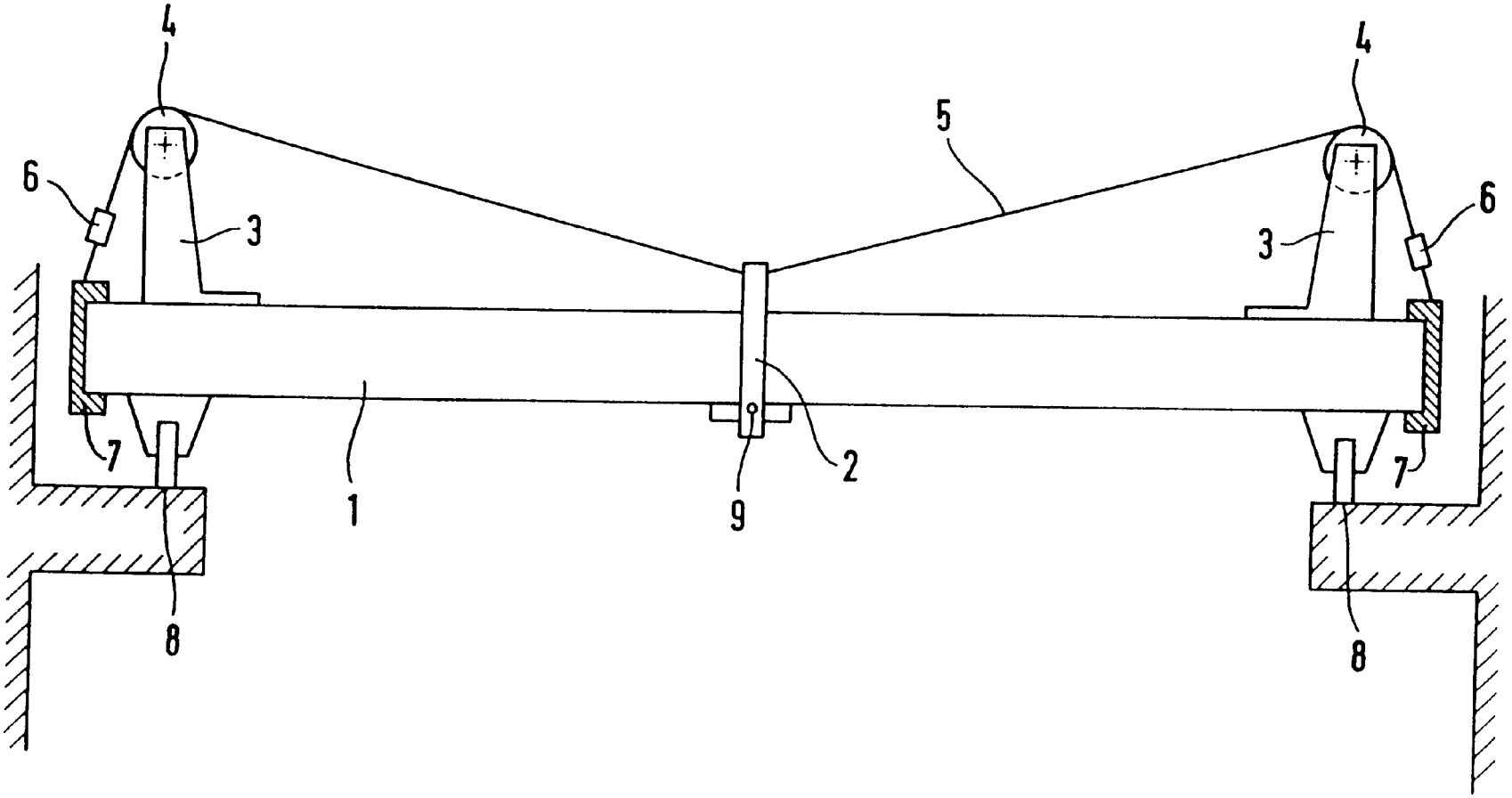
6
4
3
5
2
9
1
3
4
6
7
8
7
8

APPARATUS FOR TEMPORARILY INCREASING THE LOAD-BEARING CAPACITY OF BRIDGE GIRDERS

BACKGROUND OF THE INVENTION

1. Field of the Invention

The invention relates to an apparatus for temporarily increasing the load-bearing capacity of bridge girders, of the kind used in bridge cranes or polar bridge cranes.

When heavy components are lifted, an installed load-bearing capacity of existing bridge girders is often less than a capacity which is actually required. Such a situation arises, for instance, in unusual conversion or repair provisions in a power house of a power plant or other industrial plants, for instance when generators or steam generators in nuclear power plants are being replaced. Until now, in order to lift heavy machine parts or when placing other unplanned stresses on bridge girders, relief devices such as central support masts that are each constructed for a particular application which is involved have been put in place, or else separate hoisting tools have been installed at high cost.

2.Summary of the Invention

It is accordingly an object of the invention to provide an apparatus for temporarily increasing the load-bearing capacity of bridge girders, which overcomes the hereinaforementioned disadvantages of the heretofore-known devices of this general type, which is universally usable and which is easily mounted.

With the foregoing and other objects in view there is provided, in accordance with the invention, an apparatus for temporarily increasing a load-bearing capacity of a bridge girder, comprising portable supports having deflection pulleys; a relief cable associated with the pulleys; the supports, the pulleys and the cable temporarily mounted above bracing points of a bridge girder on both sides of a support point; and a load-bearing element carried by the relief cable for relieving the bridge girder at the support point.

Therefore, the object of temporarily increasing the load-bearing capacity of crane bridges is attained according to the invention by using a portable cable structure to reinforce the bridge girder.

In accordance with another feature of the invention, the relief cable has two ends and tensioning devices securing the two ends to the bracing points or to the bridge girder.

The supports are mounted on both ends of the bridge girder, above the bracing points and protrude upward beyond the bridge girder. The deflection pulleys that serve to receive the relief cable are associated with upper ends of the supports.

The supports are connected to one another by the relief cable, which passes over the two deflection pulleys. The relief cable is connected to the bridge girder at least at one point between the two supports, preferably in the middle of the girder. This is carried out, for instance, through the use of a load-bearing element having a lower end, for instance, which reaches under the bridge girder whose capacity is to be increased and supports it from below at this point. Thus an upwardly-directed vertical force, which engages the bridge girder at the support point, is generated from the height of the associated supports and the cable tension of the relief cable, which is tightened with the aid of the tensioning devices, such as hydraulic cylinders, or screw elements. The forces occurring as the relief cable is tightened can be favorably introduced advantageously and statically at end surfaces of the bridge girder through the use of an abutment that engages the bridge girder from below.

The load-bearing element associated with the relief cable acts like a center support that supports the bridge girder from below with a vertical force.

In accordance with a concomitant feature of the invention, the bridge girder is disposed in a power house of a power plant or in a reactor building of a nuclear power plant.

Other features which are considered as characteristic for the invention are set forth in the appended claims.

Although the invention is illustrated and described herein as embodied in an apparatus for temporarily increasing the load-bearing capacity of bridge girders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a diagrammatic, side-elevational view of a bridge girder with an associated apparatus for increasing its load-bearing capacity.

DESCRIPTION OF THE PREFERRED EMBODIMENTS

Referring now in detail to the single FIGURE of the drawing, there is seen a bridge girder 1 which rests on two bracing points 8. Supports, trestles or pedestals 3 with associated deflection pulleys 4 for receiving a relief cable 5 are mounted on both ends of the bridge girder 1, above the bracing points 8. The supports 3 are connected to one another by the relief cable 5, which runs over the deflection pulleys 4. The relief cable 5 is connected to the bridge girder 1 at a point between the two supports 3, preferably in the middle of the bridge girder 1. This is carried out through the use of a load-bearing element 2, which has a lower end that reaches under the bridge girder 1 whose capacity is to be increased and supports it from below at a point 9.

According to the invention, the bridge girder 1 may also be supported from below at various points, or in other words by a plurality of load-bearing elements 2. An upwardly-directed vertical force that engages the bridge girder 1 at the support point 9 is generated by the height of the associated supports 3 and a cable tension in the relief cable 5, which is tightened with the aid of tensioning devices 6, such as hydraulic cylinders or screw elements. The forces occurring as the relief cable 5 is tightened can be introduced in an advantageous and statically favorable manner at end surfaces of the bridge girder 1 through the use of an abutment 7 which engages the bridge girder 1 from below. In bridge girders that extend axially past the two bracing points 8 (for instance longitudinally through one entire machine room), the abutments 7 may also engage the bridge girder laterally from below or be secured temporarily to the bridge girder in some other way. The portable supports do not have to be mounted immediately above the bracing points 8, as long as the structure of the bridge girder also has other parts that suffice to absorb the forces originating in the supports and the cable.

The load-bearing element 2 associated with the relief cable 5 functions like a center support engaging the support point 9 and supporting the bridge girder 1 from below with a vertical force.

I claim:

1. In an assembly having a bridge girder with two ends and with bracing points and a support point, an apparatus for temporarily increasing a load-bearing capacity of the bridge girder, comprising:

a plurality of abutments, at least one of said abutments disposed at each end of the ends of the bridge girder;

portable supports having deflection pulleys;

a relief cable associated with said pulleys;

said cable having two ends attached to the bridge girder, at least one of said ends of said cable is attached to the girder through one of said abutments;

said supports, said pulleys and said cable temporarily mounted above the bracing points on both sides of the support point; and a load-bearing element carried by said relief cable for relieving the bridge girder at the support point.

2. The apparatus according to claim 1, wherein said relief cable has tensioning devices.

3. In a power house of a power plant having a bridge girder two ends and with bracing points and a support point, an apparatus for temporarily increasing a load-bearing capacity of the bridge girder, comprising:

a plurality of abutments, at least one of said abutments disposed at each end of the ends of the bridge girder;

portable supports having deflection pulleys;

a relief cable associated with said pulleys;

said cable having two ends attached to the bridge girder, at least one of said ends of said cable is attached to the girder through one of said abutments;

said supports, said pulleys and said cable temporarily mounted above the bracing points on both sides of the support point; and a load-bearing element carried by said relief cable for relieving the bridge girder at the support point.

4. In a reactor building of a nuclear power plant having a bridge girder two ends and with bracing points and a support point, an apparatus for temporarily increasing a load-bearing capacity of the bridge girder, comprising:

a plurality of abutments, at least one of said abutments disposed at each end of the ends of the bridge girder;

portable supports having deflection pulleys;

a relief cable associated with said pulleys;

said cable having two ends attached to the bridge girder, at least one of said ends of said cable is attached to the girder through one of said abutments;

said supports, said pulleys and said cable temporarily mounted above the bracing points on both sides of the support point;

a load-bearing element carried by said relief cable for relieving the bridge girder at the support point.

* * * * *